United States Patent [19]

Stahly

[11] 4,219,614

[45] Aug. 26, 1980

[54] ELECTROPHORETIC MIGRATION IMAGING COMPOSITION AND PROCESS USING SAME

[75] Inventor: Frederick A. Stahly, Rochester, N.Y.

[73] Assignee: Eastman Kodak Company, Rochester, N.Y.

[21] Appl. No.: 837,779

[22] Filed: Sep. 29, 1977

[51] Int. Cl.[2] ..... G03G 17/04

[52] U.S. Cl. ..... 430/38

[58] Field of Search ..... 96/1 PE, 1.3, 1 LY; 252/62.1 L

[56] References Cited

U.S. PATENT DOCUMENTS

| | | | |
|---|---|---|---|
| 3,417,019 | 12/1968 | Blyer | 252/62.1 |
| 3,585,140 | 6/1971 | Machida et al. | 252/62.1 |
| 3,650,738 | 3/1972 | Ikeda et al. | 252/62.1 |
| 3,788,995 | 1/1974 | Stahly et al. | 252/62.1 |
| 3,892,568 | 7/1975 | Ota | 96/1 PE |
| 3,976,485 | 8/1976 | Groner | 96/1 PE |

OTHER PUBLICATIONS

Wright et al. "Photosensitive Colorant Materials" Research Disclosure, Oct. 1976, pp. 39–44.

Wright et al. "Electrophoretic Migration Imaging System" Research Disclosure, Oct. 1976, pp. 51–56.

*Primary Examiner*—Roland E. Martin, Jr.

*Assistant Examiner*—John L. Goodrow

*Attorney, Agent, or Firm*—John R. Everett

[57] ABSTRACT

An electrophoretic migration imaging composition featuring certain polymeric charge control agents is provided. An electrophoretic migration imaging process using these imaging compositions is also provided.

19 Claims, 1 Drawing Figure

ELECTROPHORETIC MIGRATION IMAGING COMPOSITION AND PROCESS USING SAME

FIELD OF THE INVENTION

The present invention relates to electrophoretic migration imaging processes and imaging compositions useful in such processes.

BACKGROUND OF THE INVENTION

In the past, there has been extensive description in the patent and other technical literature of electrophoretic migration imaging processes. For example, a description of such processes may be found in U.S. Pat. Nos. 2,758,939 by Sugarman issued Aug. 14, 1956; 2,940,847; 3,100,426, 3,140,175 and 3,143,508, all by Kaprelian; 3,384,565, 3,384,488 and 3,615,558, all by Tulagin et al; 3,384,566 by Clark; and 3,383,993 by Yeh. In addition to the foregoing patent literature directed to conventional photoelectrophoretic migration imaging processes, another type of electrophoretic migration imaging process which advantageously provides for image reversal is described in Groner, U.S. Pat. No. 3,976,485 issued Aug. 24, 1976. This latter process has been termed photoimmobilized electrophoretic recording or PIER.

In general, each of the foregoing electrophoretic migration imaging processes typically employs an imaging composition containing electrostatic charge-bearing photoconductive particles, i.e., electrically photosensitive particles, positioned between two spaced electrodes, one of which may be transparent. To achieve image formation in these processes, the charge-bearing photosensitive particles positioned between the two spaced electrodes, as described above, are subjected to the influence of an electric field and exposed to activating radiation. As a result, the charge-bearing electrically photosensitive particles are caused to migrate electrophoretically to the surface of one or the other of the spaced electrodes, and one obtains an image pattern on the surface of these electrodes. Typically, a negative image is formed on one electrode, and a positive image is formed on the opposite electrode. Image discrimination occurs in the various electrophoretic migration imaging processes as a result of a net change in charge polarity of either the exposed electrically photosensitive particles (in the case of conventional electrophoretic migration imaging) or the unexposed electrically photosensitive particles (in the case of the electrophoretic migration imaging process described in the above-noted Groner patent application) so that the image formed on one electrode surface is composed ideally of electrically photosensitive particles of one charge polarity, either negative or positive polarity, and the image formed on the opposite polarity electrode surface is composed ideally of electrically photosensitive particles having the opposite charge polarity, either positive or negative respectively.

Regardless of the particular electrophoretic migration imaging process employed, the imaging compositions used in these processes typically contain the electrically photosensitive particles dispersed in an electrically insulating carrier vehicle which, at least during the time of image formation, is in liquid form. In addition, these electrophoretic migration imaging compositions may also contain a charge control agent to aid in dispersing and in imparting electrostatic charge and charge control, e.g., uniform charge polarity, to the electrically photosensitive particles of the imaging composition. (See Co. 23 of U.S. Pat. No. 3,976,485 noted above.) Such charge control agents have heretofore been selected from those materials believed to perform a similar function in conventional liquid electrographic developer compositions. A large number of different materials have been found effective as charge control agents in conventional liquid electrographic developers. A partial listing of representative such materials includes the following:

a. heavy metal soaps, e.g., cobalt naphthenate, and organic surface active agents, including non-ionic, anionic, and cationic surface active agents, as described in Beyer, U.S. Pat. No. 3,417,019 issued Dec. 17, 1968;

b. certain vinyl copolymers as described in Machida et. al., U.S. Pat. No. 3,585,140 issued June 15, 1971 which are prepared from at least three different vinyl monomers, at least one vinyl monomer being selected from each of the following groups: (i) alkyl acrylates and methacrylates in which the alkyl has 8 to 19 carbon atoms; (ii) dimethylaminoethyl methacrylate, acrylonitrile, α-aminoethylacrylic acid, α-cyanomethylacrylic acid, N,N-diphenylmethacrylamide, dimethylaminoethyl acrylate, methacrylonitrile, and diethylaminomethyl acrylate; (iii) glycidyl methacrylate, benzyl methacrylate, cyclohexyl acrylate, 2-phenoxyethyl acrylate, crotonyl acrylate, 2-phenylethyl methacrylate and 2-phenylethyl acrylate;

c. copolymers as described in Ikeda et. al., U.S. Pat. No. 3,650,738 issued Mar. 21, 1972 which are prepared from certain monomers having olephilic groups and certain monomers having a basic nitrogen atom; and d. copolymers as described in Stahly and Merrill, U.S. Pat. No. 3,788,995 issued Jan. 29, 1974 containing repeating units derived from monomers having a specified polar group and repeating units derived from monomers soluble in the carrier of the liquid developer, the polar group-containing monomers selected from materials such as sulfoalkyl acrylates and methacrylates, metal salts of sulfoalkyl acrylates and methacrylates, amine salts of sulfoalkyl acrylates and methacrylates, metal salts of acrylic and methacrylic acids, and amine salts of acrylic and methacrylic acids.

In the course of further research and investigation of electrophoretic imaging compositions involving diverse electrically photosensitive particle materials, including a wide variety of electrically photosensitive dyes and pigments, it has unexpectedly been found that certain of the aforementioned charge control agents (a)–(d), although useful in conventional liquid electrographic developer compositions, appear to deleteriously interfere with the electrical or photosensitive response of certain of these dye and pigment materials. For example, in the case of electrophoretic imaging compositions containing electrically photosensitive particles prepared from the cyan colorant material copper phthalocyanine, Colour Index No. 74160 (Such as that available from American Cyanamid under the tradename Cyan Blue GTNF), it has been found that the normal electrophoretic migration imaging capability of these compositions can be completely destroyed by the incorporation therein of certain polymeric charge control agents of the type disclosed in the aforementioned Stahly and Merrill, U.S. Pat. No. 3,788,995, for instance, a copolymer of sulfoalkyl methacrylate, styrene, and lauryl methacrylate. However, for reasons which at present are not at all clear, this same polymeric charge control agent, i.e., a copolymer derived from a sulfoalkyl methacrylate monomer, appears to function as an acceptable charge control agent for electrophoretic imaging compositions identical to that described immediately above, except that the electrically photosensitive particles of these compositions are prepared from a quinacridone magenta colorant similar to that available from Sandoz Corp. under the tradename Sandorin Brilliant Red 5BL.

The fact that certain materials function as acceptable charge control agents for certain electrophoretic imaging compositions but, at the same time, seriously interfere with or completely destroy the imaging characteristics of other electrophoretic imaging compositions poses an especially troublesome problem. For example, in the case where one contemplates employing a series of two or more differently colored monochrome electrophoretic imaging compositions to form a final multicolor image; the above-noted problem suggests that a series of different charge control agents may have to be manufactured to obtain a charge control agent which is compatible with each different monochrome imaging composition. Alternatively, in the case where one contemplates employing a single polychrome or multicolor electrophoretic imaging composition containing a mixture of at least two differently colored electrically photosensitive particles, each of which is primarily photosensitive to visible radiation of a different wavelength; the above-noted problem suggests that it is unlikely that one will be able to find a charge control agent material which is compatible with each of the differently colored electrically photosensitive particulate materials contained therein. This latter situation is of particular concern because many multicolor electrophoretic imaging compositions represent dispersions which exhibit a high degree of instability as evidenced by the non-uniform charge polarity of the electrically photosensitive particles in these compositions and by the difficulty of maintaining the electrically photosensitive particles well dispersed in these compositions. Thus, many multicolor electrophoretic imaging compositions, which exhibit otherwise useful electrophoretic migration imaging characteristics, clearly could be significantly improved if one could find a useful charge control agent that could be employed in these compositions.

SUMMARY OF THE INVENTION

In accord with the present invention there is provided an improved electrophoretic migration imaging composition which features a polymeric charge control agent. An improved electrophoretic imaging process using these imaging compositions is also provided. Electrophoretic migration imaging compositions of the invention comprise a mixture of the aforementioned polymeric charge control agent, an electrically photosensitive particulate material containing at least one dye or pigment colorant, and and electrically insulating carrier vehicle.

The polymeric charge control agents employed in the invention are copolymers having at least two different repeating units. At least one of the repeating units of these copolymers is derived from monomers selected from metal salts of sulfo acrylates and sulfo methacrylates and metal salts of acrylic and methacrylic acids (hereinafter designated type (a) monomers). And, at least one other of the repeating units of these copolymers is derived from monomers "soluble", as hereinafter defined, in the carrier vehicle of the electrophoretic migration imaging composition (hereinafter designated type (b) monomers). The amount of the above-noted type (a) and (b) monomers, as well as any other non-interfering monomers which optionally may be used to prepare the polymeric charge control agents described herein, can be varied depending upon the particular type (a) monomers, type (b) monomers, and optional non-interfering monomers selected, providing that the resultant copolymer comprises at least about $0.5\times10^{-4}$ moles/g. of repeating units derived from the type (a) monomers and an amount of type (b) monomers sufficient to render the resultant copolymer "dispersible", as hereinafter defined, in the carrier vehicle of the electrophoretic migration imaging composition.

In accord with one especially advantageous embodiment of the invention, there is provided a multicolor electrophoretic migration imaging composition comprising at least one of the above-described polymeric charge control agents; at least two differently colored electrically photosensitive particles, each of which is primarily photosensitive to visible radiation of a different wavelength; and an electrically insulating carrier vehicle.

Advantageously, it has unexpectedly been found that the polymeric charge control agents used in the invention appear to be readily compatible with a variety of useful electrically photosensitive materials employed in electrophoretic migration imaging compositions. For example, in contrast to certain other closely related polymeric charge control agent materials, the charge control agents employed in the present invention, as demonstrated in the appended Examples, can be admixed with either a mixed quinacridone magenta or a copper phthalocyanine cyan electrically photosensitive material to provide a resultant imaging composition yielding good $D_{max}$ (maximum density) and $D_{min}$ (minimum density) images and exhibiting good to excellent dispersion characteristics. Accordingly, the polymeric charge control agents featured in the invention are particularly useful in multicolor electrophoretic migration imaging compositions because they provide these compositions with good charge control (including dispersion control) properties and do not adversely affect the electrical photoresponse of the differently colored imaging material incorporated in these multicolor compositions. At the same time, these polymeric charge control agents appear to promote and enhance the color separation capability of multicolor electrophoretic imaging compositions in which they are incorporated.

BRIEF DESCRIPTION OF THE DRAWING

The FIGURE represents diagrammatically a typical imaging apparatus which employs the electrophoretic migration imaging compositions of the invention.

DESCRIPTION OF THE PREFERRED EMBODIMENTS

Figure 1:
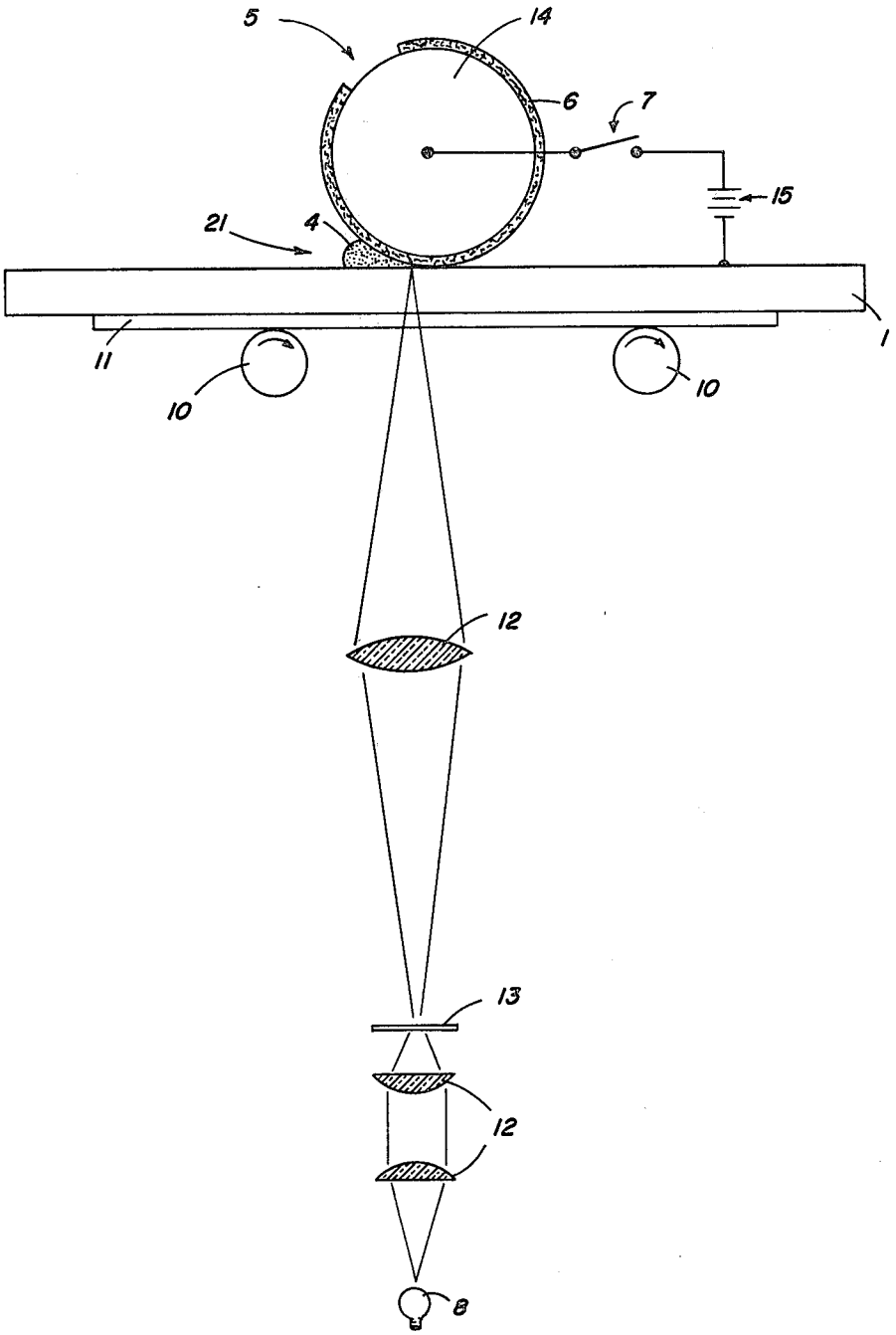

The type (a) monomers used in preparing the polymeric charge control agents described herein include Metal salts of sulfo methacrylates and sulfo acrylates having the formula:

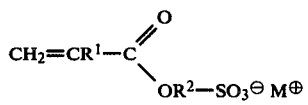

I.

where $R^1$ is hydrogen or methyl, $R^2$ is a linking group, such as an alkylene or arylene group, e.g., phenylene, and M⊕ is a metallic cation such as a transition metal cation, e.g., cobalt, an alkaline earth cation, e.g., barium or calcium, or an alkali metal cation, e.g., lithium, sodium, or potassium, preferably lithium;

metal salts of acrylic and methacrylic acids having the formula:

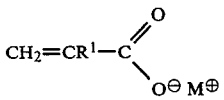

II.

wherein $R^1$ and M⊕ are as defined above; and equivalents and mixtures of the materials of formulas I and II above.

The type (b) monomers present in the polymeric charge agents described herein includes monomers "soluble" in the carrier vehicle of the electrophoretic migration imaging compositions. Monomers which are "soluble" as defined herein are monomers, which when homopolymerized, are capable of forming a homopolymer having an inherent viscosity as hereinafter defined of from about 0.1 to about 0.5 in chloroform at room temperature (about 25° C.) and a solubility (at 25° C.) in the selected carrier vehicle to the extent that at least 5 parts by weight of the homopolymer are soluble in 95 parts by weight of the carrier vehicle.

The term "inherent viscosity", $\eta_I$, as used herein is defined by the following formula:

$$\eta_I = \ln\left(\frac{\eta \text{ solution}}{\eta \text{ solvent}}\right)/C. \quad \text{III}$$

wherein $\eta$ solution is the viscosity of the solution, $\eta$ solvent is the viscosity of the solvent, and C is the concentration in grams per 100 ml. of the polymer solvent. The determination of inherent viscosity is made at a concentration of 0.25 grams of polymer in 100 ml. of chloroform at a temperature of 25° C.

A partial listing of representative type (b) soluble monomers which may be employed in the polymeric charge control agents described herein includes the following:

alkylstyrenes such as compounds having the formula

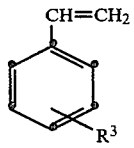

IV.

where $R^3$ is an alkyl group having from about 3 to about 10 carbon atoms;

alkoxystyrenes such as compounds having the formula

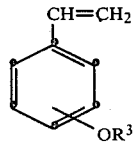

V.

where $R^3$ is as defined above, for example, p-amyloxystyrene;

alkyl acrylates such as compounds having the formula

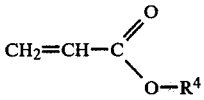

VI.

where $R^4$ is an alkyl group having from about 6 to about 22 carbon atoms;

alkyl methacrylates such as compounds having the formula

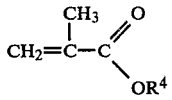

VII.

where $R^4$ is as defined above;

vinyl alkyl ethers such as compounds having the formula

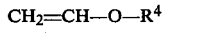

$CH_2{=}CH{-}O{-}R^4$ VIII.

where $R^4$ is as defined above;

vinyl esters of aliphatic acids such as compounds having the formula:

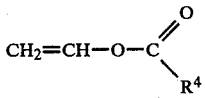

IX.

where $R^4$ is as defined above; and equivalents and mixtures thereof. Other soluble monomers may also be used.

A partial listing of particularly preferred type (a) monomers includes alkali metal salts of sulfoalkyl acrylates and methacrylates having from 2 to about 4 carbon atoms in the alkyl group and alkali metal salts of acrylic and methacrylic acid. Such monomers include lithium sulfoethyl methacrylate, lithium methacrylate, and mixtures thereof.

A partial listing of particularly preferred type (b) monomers includes 4-pentyl styrene, 4-hexyl styrene, 4-octyl styrene, t-butylstyrene, lauryl acrylate, lauryl methacrylate, hexadecyl methacrylate, octadecyl methacrylate, docosyl methacrylate, vinyl laurate, vinyl stearate, and mixtures thereof.

In addition to the above-described type (a) and type (b) monomers used to prepare the polymeric charge control agents described herein, various non-interfering monomers may optionally be used to prepare the copolymers employed in the present invention. Non-interfering monomers useful herein are monomers which are addition polymerizable with the above-described type (a) and type (b) monomers and which do not adversely affect the imaging properties of the imaging composition into which the resultant copolymers are incorporated. A partial listing from which such optional non-interfering monomers may be selected includes:

Styrenes selected from the group of styrene; haogenated styrenes; α-alkylstyrenes having 1 to about 2 carbon atoms in the alkyl group; alkylstyrenes (i.e., styrenes which are ring substituted by an alkyl group) having 1 to about 2 carbon atoms in the alkyl group, e.g., vinyltoluene; and alkoxystyrenes (i.e., ring substituted) having 1 to about 2 carbon atoms in the alkoxy group, e.g., methoxystyrene;

acrylic and methacrylic acids;

alkyl acrylates having from about 1 to about 4 carbon atoms in the alkyl group;

alkyl methacrylates having from 1 to about 4 carbon atoms in the alkyl group;

vinyl alkyl ethers having from 1 to about 4 carbon atoms in the alkyl group; and vinyl esters of aliphatic acids having from about 1 to about 4 carbon atoms in the alkyl group of the aliphatic acid; and equivalents and mixtures thereof.

As indicated hereinabove the relative proportions of the repeating units derived from the tape (a) monomers and the type (b) monomers which are present in the polymeric charge control agents described herein can be varied. In general, these polymerics charge control agents contain at least about $0.5\times10^{-4}$ moles per gram of the charge control agent of units derived from type (a) monomers and sufficient units from type (b) monomers to render the resultant charge control agent dispersible in the liquid form of the carrier vehicle. The term "dispersible" is used herein to indicate that the polymeric charge control agents are dispersible in the selected carrier vehicle (the liquid form thereof) to the extent that when a 4.0 gram quantity of the polymer is added to one liter of the carrier, at least about 3.3 grams remains dispersed therein after centrifuging the mixture at 34,000 G forces for about 60 minutes.

In accord with certain especially preferred embodiments of the present invention the polymeric charge control agents described herein contain from about 2 to about 20 weight percent of repeating units derived from the type (a) monomers, from about 30 to about 98 weight percent of repeating units derived from type (b) monomers, and optionally, from about 0.1 to about 65 weight percent of repeating units derived from the above-noted non-interfering monomers. It will be appreciated that the aforementioned weight percent ranges are general ranges and that not every type (a), type (b) or non-interfering monomer described herein can be used at all weight percent levels within the aforementioned ranges. Rather, these stated weight percent ranges are intended to indicate that each type (a), type (b), or non-interfering monomer described herein can be used at some level within these weight percent ranges and provide good results.

A partial listing of representative polymeric charge control agents preferred for use in the present invention includes poly(vinyltoluene-co-lauryl methacrylate-co-lithium methacrylate-co-methacrylic acid), poly(styrene-co-lauryl methacrylate-co-lithium sulfoethyl methacrylate), poly(vinyltoluene-co-lauryl methacrylate-co-lithium methacrylate), poly(styrene-co-lauryl methacrylate-co-lithium methacrylate), poly(t-butylstyrene-co-lauryl methacrylate-co-lithium methacrylate), or poly(t-butylstyrene-co-lithium methacrylate).

The copolymers employed as the polymeric charge control agents herein can be prepared by well-known, conventional addition polymerization tecniques. If further detail is desired concerning specific addition polymerization techniques useful in preparing these copolymers, reference may be made to Stahly and Merrill, U.S. Pat. No. 3,788,995.

As indicated hereinabove, in addition to the above-described polymeric charge control agents, the electrophoretic imaging compositions of the invention also contain electrically photosensitive particles. Electrically photosensitive particles useful in these imaging compositions typically have an average particle size within the range of from about 0.1 micron to about 20 microns, preferably from about 0.01 to about 5 microns.

It may be noted that the physical composition of these electrically photosensitive particles may vary widely. For example, single component particles which are both photosensitive to activating radiation of the desired wavelength and have the desired color may be used as described in Sugarman, U.S. Pat. No. 2,758,939. Examples of such particles are various inorganic pigments such as an oxide, sulfide, selenide, telluride, or iodide of cadmium, zinc, mercury, antimony, bismuth, thallium, indium, molybdenum, aluminum and lead. Other photoconductive inorganic materials include arsenic trisulfide, cadmium arsenide, lead chromate, selenium, sulfur, etc. Various organic photoconductive pigments such as phthalocyanine pigments, azo pigments, quinacridone pigments, anthraquinone pigments, and the like may also be used. The above-noted substances are well known photoconductive materials.

In addition, multi-component electrically photosensitive particles such as those described in Sugarman, U.S. Pat. No. 2,758,939 and Kaprelian U.S. Pat. No. 3,143,508 issued Aug. 4, 1964 may be used. In such case, the particles may comprise a separate photoconductive component and a separate colorant component such as a dye or pigment and, optionally, a binder such as a polymeric material, chemical and spectral sensitizers such as various sensitizing dyestuffs, ect. In addition, one or more filter layers may be present in these multi-component particles.

The electrically photosensitive particles used in the present invention may be all of one color to form a monochrome image.

Alternatively, in accord with certain especially preferred embodiments of the invention, an admixture of differently colored particles may be used to form multicolor electrophoretic imaging compositions in accord with the invention. For example, a mixture of cyan, magenta, and yellow particles which are electrically photosensitive to red, green, and blue light, respectively, may be used to form, through subtractive color formation, multicolor images in an electrophoretic migration imaging process in accord with the invention. In accord with the various multicolor embodiments of the imaging compositions of the invention, random mixtures of two, three, or more differently colored electrically photosensitive particles are employed. Each differently colored particle is responsive to a specific given wavelength of activating radiation so that multiple color images are produced by a single exposure of the electrically photosensitive particle mixture to light composed of a mixture of the various specific wavelength radiation to which each of the differently colored particles are sensitive.

Typically, the electrically insulating carrier vehicle of the electrophoretic imaging compositions of the invention is an electrically insulating liquid, or an electrically insulating, liquefiable matrix material, such as a heat- and/or solvent-solftenable polymeric material or a thixotropic polymeric material. Thus, the electrically insulating carrier vehicle used in the imaging compositions described herein may assume a variety of physical forms and may be selected from a variety of different materials. For example, the carrier vehicle may be a matrix of an electrically insulating, normaly solid polymeric material capable of being softened or liquefied upon application of heat, solvent, and/or pressure so that the electrically photosensitive particulate material admixed therein can migrate through the matrix. In another, more typical embodiment of the invention, the carrier vehicle can comprise an electrically insulating liquid such as decane, paraffin, Sohio Oderless Solvent 3440 (a kerosene fraction marketed by the Standard Oil Company, Ohio), various isoparaffinic hydrocarbon liquids such as those sold under the trademark Isopar G® by Exxon Corporation and having a boiling point in the range of 145° C. to 186° C., various halogenated hydrocarbons such as carbon tetrachloride, trichlorofluoromethane, and the like, various alkylated aromatic hydrocarbon liquids such as the alkylated benzenes, for example, xylenes, and other alkylated aromatic hydrocarbons such as are described in U.S. Pat. No. 2,899,335. For example of one such useful alkylated aromatic hydrocarbon liquid which is commercially available under the trademark Solvesso 100®has a boiling range of about 155° C. to about 174° C. and is composed of 1.1 volume percent paraffins and 98.9 volume percent alkylated aromatics. Typically, whether solid or liquid at normal room temperatures, i.e., about 25° C., the electrically insulating carrier vehicle used in the present invention is a material having a resistivity greater than about $10^9$ ohm-cm, preferably greater than about 10 ohm-cm.

When the electrically photosensitive particles used in the present invention are incorporated in a carrier vehicle, such as one of the above-described electrically insulating liquids, various other addenda may also be incorporated in the resultant imaging composition. For example, the polymeric charge control agents described herein may be incorporated in the imaging composition at this time. Also, if desired, various spectral and chemical sensitizers for the imaging composition may be incorporated in the carrier vehicle. In addition, various polymeric binder materials such as various natural, semi-synthetic or synthetic resins, may be dispersed or dissolved in the electrically insulating carrier vehicle to serve as a fixing material for the final photosensitive particle image formed on one of the spaced electrodes used in electrophoretic migration imaging systems. The use of such fixing addenda is conventional and well-known in the closely related art of liquid electrographic developer compositions so that extended discussion thereof is unnecessary herein.

In typical electrophoretic imaging compositions of the invention, the amount of each of the aforementioned components, i.e., the polymeric charge control agent, the electrically photosensitive particulate material, and the carrier vehicle can be widely varied. In general, useful results may be obtained using imaging compositions of the invention containing from about 0.05 to about 2 parts by weight of the polymeric charge control agent and from about 0.05 to about 2 parts by weight of electrically photosensitive particulate material for each 10 parts by weight of the carrier vehicle. However, it should be understood that in certain specialized applications, amounts of materials outside the aforementioned weight ranges may also be employed within the scope of the present invention.

The process of the present invention will be described in more detail with reference to the accompanying drawing, FIG. 1, which illustrates a typical apparatus which employs the electrophoretic migration imaging composition and process of the invention.

FIG. 1 shows a transparent electrode 1 supported by two rubber drive rollers 10 capable of imparting a translating motion to electrode 1 in the direction of the arrow. Electrode 1 may be composed of a layer of optically transparent material, such as glass or an electrically insulating, transparent polymeric support such as polyethylene terephthalate, covered with a thin, optically transparent, conductive layer such as tin oxide, indium oxide, nickel, and the like. Optionally, depending upon the particular type of electrophoretic migration imaging process desired, the surface of electrode 1 may bear a "dark charge exchange" material, such as a solid solution of an electrically insulating polymer and 2,4,7,trinitro-9-fluorenone as described by Groner in U.S. Pat. No. 3,976,485 issued Aug. 24, 1976.

Spaced opposite electrode 1 and in pressure contact therewith is a second electrode 5 in the form of an idler roller which serves as a counter electrode to electrode 1 for producing the electric field used in the electrophoretic migration imaging process. Typically, electrode 5 has on the surface thereof a thin, electrically insulating layer 6. Electrode 5 is connected to one side of the power source 15 by switch 7. The opposite side of the power source 15 is connected to electrode 1 so that as an exposure takes place, switch 7 is closed and an electric field is applied to the electrophoretic imaging composition 4 which is positioned in the nip 21 between electrodes 1 and 5.

The electrophoretic imaging composition 4 may be positioned between electrodes 1 and 5 by applying composition 4 to either or both of the surfaces of electrodes 1 and 5 prior to the imaging process or by injecting electrically imaging composition 4 between electrodes 1 and 5 during the electrophoretic migration imaging process.

As shown in FIG. 1, exposure of electrically photosensitive particulate material contained in imaging composition 4 takes place by use of an exposure system consisting of light source 8, an original image 11 to be reproduced, such as a photographic transparency, a lens system 12, and any necessary or desirable radiation filters 13, whereby electrically photosensitive material in imaging composition 4 is irradiated with a pattern of activating radiation corresponding to original image 11. Although the electrophoretic migration imaging system represented in FIG. 1 shows electrode 1 to be transparent to activating radiation from light source 8, it is possible to irradiate imaging composition 4 in the nip 21 between electrodes 1 and 5 without either of electrodes 1 or 5 being transparent. In such a system, although not shown in FIG. 1, the exposure source 8 and lens system 12 is arranged so that imaging composition 4 is exposed in the nip or gap 21 between electrodes 1 and 5.

As shown in FIG. 1, electrode 5 is a roller electrode having a conductive core 14 connected to power source 15. The core is in turn covered with a layer of insulating material 6. Insulating material 6 serves to control the electrical field in the nip 21 of the apparatus of FIG. 1. The term "blocking electrode" may be used, as is conventional in the art of electrophoretic migration imaging, to refer to electrode 5.

Although electrode 5 is shown as a roller electrode and electrode 1 is shown as essentially a translatable, flat plate electrode in FIG. 1, either or both of these electrodes may assume a variety of different shapes such as a web electrode, rotating drum electrode, plate electrode, and the like as is well known in the field of electrophoretic migration imaging. In general, during a typical electrophoretic migration imaging process wherein imaging composition 4 contains electrically photosensitive material dispersed in an electrically insulating, liquid carrier vehicle, electrodes 1 and 5 are spaced such that they are in pressure contact or very close to one another during the electrophoretic migration imaging process, e.g., less than 50 microns apart. However, where the carrier vehicle of imaging composition 4 is, for example, a heat-softenable or other liquefiable material coated as a separate layer on electrode 1 and/or 5, these electrodes may be spaced more than 50 microns apart during the imaging process.

The strength of the electric field imposed between electrodes 1 and 5 during the electrophoretic migration imaging process of the present invention may vary considerably; however, it has generally been found that optimum image density and resolution are obtained by increasing the field strength to as high a level as possible without causing electrical breakdown of the carrier medium in the electrode gap. For example, when electrically insulating liquids such as isoparaffinic hydrocarbons are used as the carrier vehicle in the imaging apparatus of FIG. 1, the applied voltage across electrodes 1 and 5 typically is within the range of from about 100 volts to about 4 kilovolts or higher.

As explained hereinabove, image formation occurs in electrophoretic migration imaging processes as the result of the combined action of activating radiation and electric field on the electrically photosensitive particulate material contained in imaging composition 4 dispersed between electrodes 1 and 5 in the attached drawing. Typically, for best results, field application and exposure to activating radiation occur concurrently. However, as would be expected, by appropriate selection of various process parameters such as field strength, activating radiation intensity, incorporation of suitable light sensitive addenda in or together with the electrically photosensitive particles contained in the electrophoretic imaging composition, e.g., by incorporation of a persistent photoconductive material, and the like, it is possible to alter the timing of the exposure and field application events so that one may use sequential exposure and field application events, rather than concurrent field application and exposure events.

When disposed between imaging electrodes 1 and 5 of FIG. 1, electrically photosensitive particulate material contained in imaging composition 4 exhibits an electrostatic charge polarity, most likely as a result of the particles interacting with the carrier vehicle in which they are dispersed, for example, an electrically insulating liquid, such as occurs in conventional liquid electrographic developing compositions composed of toner particles which acquire a charge upon being dispersed in an electrically insulating carrier liquid.

Image discrimination occurs in the electrophoretic migration imaging process of the present invention as a result of the combined application of electric field and activating radiation on the electrically photosensitive particulate material dispersed between electrodes 1 and 5 of the apparatus shown in FIG. 1. That is, in a typical imaging operation, upon application of an electric field between electrodes 1 and 5, the charge-bearing, electrically photosensitive particles of imaging composition 4 are attracted in the dark to either electrodes 1 or 5, depending upon which of these electrodes has a polarity opposite to that of the original charge polarity acquired by the electrically photosensitive particles. And, upon exposing these particles to activating electromagnetic radiation, it is theorized that there occurs neutralization or reversal of the charge polarity associated with either the exposed or unexposed particles. In typical electrophoretic migration imaging systems wherein electrode 1 bears a conductive surface, the exposed, electrically photosensitive particles of the imaging composition, upon coming into electrical contact with such conductive surface, undergo an alteration (usually a reversal) of their original charge polarity as a result of the combined application of electric field and activating radiation. Alternatively, in the case of photoimmobilized electrophoretic recording (PIER), wherein the surface of electrode 1 bears a dark charge exchange material as described by Groner in aforementioned U.S. Pat. No. 3,976,485, one obtains reversal of the charge polarity of the unexposed particles, while maintaining the original charge polarity of the exposed electrically photosensitive particles, as these particles come into electrical contact with the dark charge exchange surface of electrode 1. In any case, upon the application of electric field and activating radiation to electrically photosensitive particulate material contained in imaging composition 4 disposed between electrodes 1 and 5 of the apparatus shown in FIG. 1, one can effectively obtain image discrimination so that an image pattern is formed by the electrically photosensitive particles which corresponds to the original pattern of activating radiation. Typically, using the apparatus shown in FIG. 1, one obtains a visible image on the surface of electrode 1 and a complementary image on the surface of electrode 5 (i.e., an image which is a reversal of that on electrode 1).

Subsequent to the application of the electric field and exposure to activating radiation, the images which are formed on the surface of electrodes 1 and/or 5 of the apparatus shown in FIG. 1 may be temporarily or permanently fixed to these electrodes or may be transferred to a final image receiving element. Fixing of the final particle image can be effected by various techniques, for example, by applying a resinous coating over the surface of the image bearing substrate. For example, one may fix the image or images formed on the surface of electrodes 1 and/or 5 by incorporating a polymeric binder material in the carrier vehicle of the imaging composition. Many such binders (which are well known for use in liquid electrophotographic liquid developers) are known to acquire a charge polarity upon being admixed in a carrier vehicle and therefore will, themselves, electrophoretically migrate to the surface of one or the other of the electrodes. Alternatively, a coating of a resinous binder (which has been admixed in the carrier vehicle), may be formed on the surfaces of electrodes 1 and/or 5 upon evaporation of the liquid carrier.

The following examples are presented to further illustrate the invention.

EXAMPLES

Imaging Apparatus

An imaging apparatus was used in each of the following examples to carry out the electrophoretic migration imaging process described herein. This apparatus was a device of the type illustrated in FIG. 1. In this apparatus, a translating NESATRON (a trademark of PPG for a conductive indium oxide sputtered glass) glass plate served as electrode 1 and was in pressure contact with a 10 centimeter diameter, resilient polymer coated aluminum roller 14 covered with a dielectric layer. Plate 1 was supported by two 2.8 cm. diameter rubber drive rollers 10 positioned beneath film plate 1 such that a 2.5 cm. opening, parallel with the axis of the aluminum roller 14, existed to allow exposure of electrically photosensitive particles 4 to activating radiation. The original transparency 11 to be reproduced was taped to the back side of film plate 1. The light source consisted of a Kodak 860H Carousel® Projector with a 500 watt tungsten-halogen lamp. The light was modulated with a Kodak No. 5 flexible M-carbon eleven step 0.3 neutral density step tablet (not shown in FIG. 1). One of two original transparencies was used for evaluation purposes depending upon whether a multicolor electrophoretic imaging composition or a monochrome imaging composition was being evaluated.

In the case of a monochrome imaging composition, the original transparency 11 to be reproduced was a black and white transparency containing line copy.

In the case of multicolor imaging compositions the original transparency 11 to be reproduced consisted of adjacent strips of clear (WO), red (W29), green (W61) and blue (W47B) filters. The incident light intensity in the clear and colored portions of the transparency (with no neutral density step tablet) was as follows:

| Filters | | Intensity erg/cm$^2$/sec: |
|---|---|---|
| WO | Clear | $1.3 \times 10^5$ |
| W29 | Red | $3.8 \times 10^4$ |
| W61 | Green | $6.6 \times 10^3$ |
| W47B | Blue | $4.6 \times 10^3$ |

The voltage between the electrode 5 and film plate 1 was about 0.8 kv. Film plate 1 was negative polarity in all cases. The translational speed of film plate 1 was about 25 cm. per second. In the following examples, image formation occurs on the surfaces of film plate 1 and electrode 5 after simultaneous application of light exposure and electric field to the dispersion evaluated for use as an electrophoretic migration imaging composition 4 which was placed in nip 21 between the electrodes 1 and 5. If the dispersion being evaluated for use as imaging composition 4 appeared useful; one obtained a composition exhibiting uniform small particle size, good or excellent particle dispersibility, and negative-appearing image reproduction of original 11 on electrode 5 and a complementary image on electrode 1, both of these images exhibiting useful $D_{max}$ (maximum density) and $D_{min}$ (minimum density) values.

EXAMPLE 1

A series of eight monochrome dispersions were prepared as electrophoretic migration imaging compositions to evaluate the following copolymers as polymeric charge control agents:

Charge Control Agent Identification

A - Poly(styrene-co-lauryl methacrylate-co-2-sulfoethylmethacrylate) having a monomer weight ratio of 46/46/8, respectively (control — outside scope of the invention)

B - Poly(styrene-co-lauryl methacrylate-co-2-sulfoethyl methacrylate) having a monomer weight ratio of 34/50/16, respectively (outside scope of the invention)

C - Poly(styrene-co-lauryl methacrylate-co-lithium sulfoethyl methacrylate) having a monomer weight ratio of 46/46/8, respectively (within scope of the invention)

D - Poly(vinyl toluene-co-lauryl methacrylate-co-lithium methacrylate-co-methacrylic acid) having a monomer weight ratio of 56/40/3.6/0.4, respectively (within scope of the invention)

In the series of imaging dispersions described in this Example, two separate monochrome dispersions were prepared for each of the above-described charge control agents, one containing a cyan pigment, i.e., copper phthalocyanine (available commercially as Cyan Blue GTNF) and one containing a quinacridone magenta pigment similar to the mixed quinacridone Sandorin Brilliant Red 5BL (available commercially from Sandoz Corp.). Each of these dispersions was prepared as follows:

Two grams of charge control agent were dissolved in 40 grams of 1,2-dichloroethane. Two grams of pigment were added and the dispersion was milled for 5 to 6 days in a glass jar containing 0.125 diameter stainless steel balls. The dispersion was then washed free of the balls using 24 grams of Solvesso 100® and a small portion of 1,2-dichloroethane when necessary. 91.35 grams of a Piccotex 100® solution in 1,2-dichloroethane (the solution containing 26% by weight of Piccotex 100®) was then added and the total dispersion was mixed with a magnetic stirrer bar from 15 min. to 2 hrs. 43 grams of Isopar G® were then added while stirring was continued. The dispersion was then transferred to a rotary evaporator to remove the 1,2-dichloroethane. Final concentration was adjusted to 2% by weight pigment with Isopar G®. Each of the final dispersions to be evaluated as an imaging composition had the following composition:

| | |
|---|---|
| Charge Control Agent Copolymer | 2% (by weight) |
| Pigment | 2% (by weight) |
| Solvesso 100® | 24% (by weight) |
| Piccotex 100® | 23.5% (by weight) |
| Isopar G® | 48.5% (by weight) |

Each of the above-noted monochrome dispersions was evaluated in the above-described Imaging Apparatus. The results obtained for each dispersion are stated in terms of the charge control agent and the colorant contained therein in Table 1.

As can be seen from Table 1 whereas charge control agents A and B provided poor dispersions or no image when admixed in the Cyan Blue GTNF pigment-containing monochrome dispersions, charge control agents C and D used in the present invention provided good or excellent dispersions and useful $D_{max}$ and $D_{min}$ image values when admixed in both the Cyan Blue GTNF pigment and quinacridone pigment monochrome dispersions.

TABLE 1

| | Cyan Blue GTNF pigment | | | | |
|---|---|---|---|---|---|
| | | Positive Image | | Negative Image | |
| Charge Control Agent | Comments | $D_{max}$ | $D_{min}$ | $D_{max}$ | $D_{min}$ |
| A (control) | No image | .01 | .01 | .02 | .02 |

TABLE 1-continued

| | | | | | |
|---|---|---|---|---|---|
| B (control) | Poor dispersion, severe agglomeration of photosensitive particles led to streak, high contrast image | 1.27 | 0.0 | 0.95 | 0.08 |
| C | Good dispersion | 1.64 | 0.43 | 1.49 | 0.09 |
| D | Excellent dispersion | 1.88 | 0.47 | 1.63 | 0.02 |

| | Mixed Quinacridone pigment | | | | |
|---|---|---|---|---|---|
| | | Positive Image | | Negative Image | |
| Charge Control Agent | Comments | $D_{max}$ | $D_{min}$ | $D_{max}$ | $D_{min}$ |
| A (control) | Dispersion contains large particles | 1.12 | 0.28 | 0.83 | 0.01 |
| B (control) | Dispersion contains large particles | 1.12 | 0.34 | 0.76 | 0.01 |
| C | Good dispersion | 1.18 | 0.51 | 0.77 | 0.07 |
| D | Excellent dispersion | 1.24 | 0.48 | 0.82 | 0.02 |

EXAMPLE 2

In this Example a series of four polychrome or multicolor imaging compositions were prepared, each containing one of the polymeric charge control agents labelled A, B, C, or D in Example 1. Each of the multicolor compositions of this Example contained a mixture of the electrically photosensitive cyan and magenta pigment material used in Example 1. The multicolor compositions of this example were prepared by combining in a 1:1 volume ratio the cyan and magenta monochrome dispersions prepared for each of the A, B, C, and D polymeric charge control agents described in Example 1. Each of the multicolor imaging compositions of this example was then evauluated using the above-described Imaging Apparatus. Thereafter, both the negative and positive images obtained using each of these multicolor imaging compositions were evaluated for image quality and color separation. Image quality was evaluated in terms of whether useful $D_{max}$ and $D_{min}$ images were obtained for each of white, red, green, and blue light exposures. The results which are obtained are set forth in Table 2. As is apparent from Table 2, charge control agents A and B, although similar to those used in the present invention, provided multicolor imaging compositions exhibiting no or only slight color separation and generally poor image quality. In contrast, polymeric charge control agents C and D used in the present invention provided good image quality and good color separation.

TABLE 2

| | Positive Image | | Negative Image | |
|---|---|---|---|---|
| Charge Control Agent | Image Quality | Color Separation | Image Quality | Color Separation |
| A (control) | Poor - No cyan image | None | Poor - No cyan image | None |
| B (control) | Poor - cyan image only partially obtained | Poor | Poor - Somewhat better than the positive image for this charge control agent. | Slight |
| C | Good | Good | Good | Good |
| D | Good | Good | Good | Good |

The invention has been described in detail with particular reference to certain preferred embodiments thereof, but it will be understood that variations and modifications can be effected within the spirit and scope of the invention.

I claim:

1. In an electrophoretic migration imaging composition comprising a mixture of an electrically photosensitive particulate material containing at least one dye or pigment colorant and an electrically insulating carrier vehicle, the improvement wherein there is incorporated in said composition a polymeric charge control agent comprising a copolymer having at least two different repeating units, (a) one of said units being present in an amount of at least about $0.5 \times 10^{-4}$ moles/gram of said copolymer and being derived from monomers selected from the group consisting of metal salts of sulfo acrylates and methacrylates and metal salts of acrylic and methacrylic acids, and (b) one of said repeating units being derived from monomers soluble in said carrier vehicle and being present in an amount sufficient to render said copolymer dispersible in said carrier vehicle.

2. An electrophoretic migration imaging composition as defined in claim 1 wherein said polymeric charge control agent comprises from about 2 to about °weight percent of repeating units derived from monomers designated (a) and from about 30 to about 98 weight percent of repeating units derived from monomers designated (b).

3. An electrophoretic migration imaging composition as defined in claim 1 wherein said repeating units derived from monomers designated (b) are selected from the group consisting of alkylstyrenes having from about 3 to about 10 carbon atoms in the alkyl group, alkoxystyrenes having from about 3 to about 10 carbon atoms in the alkyl group, alkyl acrylates having about 6 to about 22 carbon atoms in the alkyl group, alkyl methacrylates having about 6 to about 22 carbon atoms in the alkyl group, vinyl alkyl ethers having about 6 to about 22 carbon atoms in the alkyl group, and vinyl esters of aliphatic acids having from about 6 to about 22 carbon atoms in the alkyl group of said acids.

4. An electrophoretic migration imaging composition as defined in claim 1 wherein said polymeric charge control agent has at least three different repeating units, two of said repeating units being selected from said monomers designated (a) and (b) and at least one of said repeating units being a non-interfering monomer.

5. An electrophoretic migration imaging composition as defined in claim 1 wherein said monomers designated (a) are selected from the group consisting of alkali metal salts of sulfoalkyl acrylates and methacrylates having from 2 to about 4 carbon atoms in the alkyl group and from alkali metal salts or acrylic and methacrylic acid.

6. An electrophoretic migration imaging composition as defined in claim 1 wherein said monomers designated (a) are selected from the group consisting of lithium sulfoethyl methacrylate or lithium methacrylate.

7. An electrophoretic migration imaging composition as defined in claim 1 wherein said polymeric charge control agent is poly(vinyltoluene-co-lauryl methacrylate-co-lithium methacrylate-co-methacrylic acid), poly(styrene-co-lauryl methacrylate-co-lithium sulfoethyl methacrylate), poly(vinyltoluene-co-lauryl methacrylate-co-lithium methacrylate), poly(styrene-co-lauryl methacrylate-co-lithium methacrylate), poly(t-butylstyrene-co-lauryl methacrylate-co-lithium methacrylate), or poly(t-butylstyrene-co-lithium methacrylate).

8. In an electrophoretic migration imaging composition comprising a mixture of an electrically photosensitive particulate material containing at least one dye or pigment colorant and an electrically insulating carrier liquid, the improvement wherein there is incorporated in said composition a polymeric charge control agent comprising a copolymer having at least three different repeating units, (a) one of said units being present in an amount of at least about $0.5\times10^{-4}$ moles/gram of said copolymer and being derived from monomers selected from the group consisting of metal salts of sulfo acrylates and methacrylates and metal salts of acrylic and methacrylic acids, (b) one of said repeating units being derived from monomers soluble in said carrier vehicle and being present in an amount sufficient to render said copolymer dispersible in said carrier liquid, and (c) one of said repeating units being a noninterfering monomer.

9. An electrophoretic migration imaging composition as defined in claim 8 wherein said polymeric charge control agent comprises from about 2 to about 20 weight percent of repeating units derived from monomers designated (a), from about 30 to about 98 weight percent of repeating units derived from monomers designated (b), and from about 0.1 to about 65 weight percent of repeating units derived from monomers designated (c).

10. An electrophoretic migration imaging composition as defined in claim 9 wherein said repeating units derived from monomers designated (b) are selected from the group consisting of alkylstyrenes having from about 3 to about 10 carbon atoms in the alkyl group, alkoxystyrenes having from about 3 to about 10 carbon atoms in the alkyl group, alkyl acrylates having about 6 to about 22 carbon atoms in the alkyl group, alkyl methacrylates having about 6 to about 22 carbon atoms in the alkyl group, vinyl alkyl ethers having about 6 to about 22 carbon atoms in the alkyl group, and vinyl esters of aliphatic acids having from about 6 to about 22 carbon atoms in the alkyl group of said acids.

11. An electrophoretic migration imaging composition as defined in claim 8 wherein said monomers designated (a) are selected from the group consisting of alkali metal salts of sulfoalkyl acrylates and methacrylates having from 2 to about 4 carbon atoms in the alkyl group and from alkali metal salts of acrylic and methacrylic acid.

12. An electrophoretic migration imaging composition as defined in claim 8 wherein said monomers designated (a) are selected from the group consisting of lithium sulfoethyl methacrylate or lithium methacrylate.

13. An electrophoretic migration imaging composition as defined in claim 8 wherein said monomers designated (c) are selected from the group consisting of styrene, halogenated styrene, $\alpha$-alkylstyrenes having from 1 to about 2 carbon atoms in the alkyl group, alkylstyrenes having 1 to about 2 carbon atoms in the alkyl group, and alkoxystyrenes having 1 to about 2 carbon atoms in the alkyl group.

14. An electrophoretic migration imaging composition as defined in claim 8 wherein said polymeric charge control agent is poly(vinyltoluene-co-lauryl methacrylate-co-lithium methacrylate-co-methacrylic acid), poly(styrene-co-lauryl methacrylate-co-lithium sulfoethyl methacrylate), poly(vinyltoluene-co-lauryl methacrylate-co-lithium methacrylate), poly(styrene-co-lauryl methacrylate-co-lithium methacrylate), poly(t-butylstyrene-co-lauryl methacrylate-co-lithium methacrylate), or poly(t-butylstyrene-co-lithium methacrylate).

15. A multicolor electrophoretic migration imaging composition comprising a mixture of at least two differently colored electrically photosensitive particles, each of which is primarily photosensitive to visible radiation of a different wavelength and contains a dye or pigment as colorant; an electrically insulating carrier vehicle; and a polymeric charge control agent comprising a copolymer having at least two different repeating units, (a) one of said units being present in an amount of at least about $0.5\times10^{-4}$ moles/grams of said copolymer and being derived from monomers selected from the group consisting of metal salts of sulfo acrylates and methacrylates and metal salts of acrylic and methacrylic acids, and (b) one of said repeating units being derived from monomers soluble in said carrier vehicle and being present in an amount sufficient to render said copolymer dispersible in said carrier vehicle.

16. A multicolor electrophoretic migration imaging composition as defined in claim 15 wherein said composition comprises a mixture of cyan, magenta, and yellow electrically photosensitive particles.

17. An electrophoretic migration imaging composition comprising a mixture of an electrically photosensitive particulate material containing at least one dye or pigment colorant; an electrically insulating carrier vehicle; a polymeric binder; and a polymeric charge control agent comprising a copolymer having at least two different repeating units, (a) one of said units being present in an amount of at least about $0.5\times10^{-4}$ moles/gram of said copolymer and being derived from monomers selected from the group consisting of metal salts of sulfo acrylates and methacrylates and metal salts of acrylic and methacrylic acids, and (b) one of said repeating units being derived from monomers soluble in said carrier vehicle and being present in an amount sufficient to render said copolymer dispersible in said carrier vehicle.

18. An electrophoretic migration imaging composition as defined in claim 17 wherein said composition contains from about 0.05 to about 2 parts by weight of said charge control agent for each 10 parts by weight of carrier vehicle.

19. In an electrophoretic migration imaging process which comprises:

subjecting an imaging composition positioned between at least two electrodes to an applied electric field, said imaging composition comprising a mixture of electrically photosensitive material containing at least one dye or pigment colorant and an electrically insulating carrier vehicle, and exposing said composition to an image pattern of radiation to which the composition is photosensitive, thereby obtaining image formation on at least one of said electrodes;

the improvement which comprises using in said imaging composition a polymeric charge control agent comprising a copolymer having at least two different repeating units, (a) one of said units being present in an amount of at least about $0.5\times10^{-4}$ moles/gram of said copolymer and being derived from monomers selected from the group consisting of metal salts of sulfo acrylates and methacrylates and metal salts of acrylic and methacrylic acids, and (b) one of said repeating units being derived from monomers soluble in said carrier vehicle and being present in an amount sufficient to render said copolymer dispersible in said carrier vehicle.

* * * * *